US011635228B2

(12) United States Patent
Zhu et al.

(10) Patent No.: US 11,635,228 B2
(45) Date of Patent: Apr. 25, 2023

(54) AIR CONDITIONER INDOOR UNIT

(71) Applicant: GD MIDEA AIR-CONDITIONING EQUIPMENT CO., LTD., Foshan (CN)

(72) Inventors: Maocheng Zhu, Foshan (CN); Shengqi Li, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 126 days.

(21) Appl. No.: 16/776,859

(22) Filed: Jan. 30, 2020

(65) Prior Publication Data

US 2020/0166239 A1 May 28, 2020

Related U.S. Application Data

(63) Continuation of application No. PCT/CN2018/084928, filed on Apr. 27, 2018.

(30) Foreign Application Priority Data

Jul. 31, 2017 (CN) ..... 201710643842.2
Jul. 31, 2017 (CN) ..... 201720948871.5

(51) Int. Cl.
*F24F 13/00* (2006.01)
*F24F 13/14* (2006.01)
(Continued)

(52) U.S. Cl.
CPC ..... *F24F 13/1413* (2013.01); *F24F 1/0011* (2013.01); *F24F 1/0057* (2019.02); *F24F 13/24* (2013.01)

(58) Field of Classification Search
CPC ..... F24F 13/14; F24F 13/1413
See application file for complete search history.

(56) References Cited

U.S. PATENT DOCUMENTS 3,710,889 A 1/1973 Lamy
2012/0115409 A1* 5/2012 Kelpentidjian ..... F24F 13/068 454/270

(Continued)

FOREIGN PATENT DOCUMENTS

CN 2731543 Y 10/2005
CN 104697056 A 6/2015

(Continued)

OTHER PUBLICATIONS

CN204555023U_Description_202109281813, machine translation of CN204555023U (Year: 2015).*

(Continued)

*Primary Examiner* — Ko-Wei Lin
(74) *Attorney, Agent, or Firm* — Anova Law Group PLLC

(57) ABSTRACT

An air conditioner indoor unit includes a body including an air outlet, an outer air deflector provided at the air outlet and configured to open and close the air outlet, and an inner air deflector located at an inner side of the outer air deflector. The inner air deflector includes a plurality of vent holes penetrating the inner air deflector in a thickness direction of the inner air deflector. A total area of the plurality of vent holes is not smaller than 50% of a total area of the inner air deflector.

12 Claims, 14 Drawing Sheets

(51) Int. Cl.

| | |
|---|---|
| ***F24F 1/0011*** | (2019.01) |
| *F24F 1/0057* | (2019.01) |
| *F24F 13/24* | (2006.01) |

(56) References Cited

U.S. PATENT DOCUMENTS

| | | | | |
|---|---|---|---|---|
| 2012/0122387 | A1* | 5/2012 | Nicola | B60H 1/3428 454/155 |
| 2014/0165459 | A1* | 6/2014 | Reinders | A01G 9/246 47/17 |
| 2016/0252256 | A1* | 9/2016 | Bagwell | F24C 15/20 454/61 |
| 2018/0172288 | A1 | 6/2018 | Kim et al. | |
| 2018/0313552 | A1* | 11/2018 | Lee | F24F 1/0047 |
| 2019/0078804 | A1* | 3/2019 | Ishikawa | F24F 13/14 |

FOREIGN PATENT DOCUMENTS

| | | | |
|---|---|---|---|
| CN | 104697059 | A | 6/2015 |
| CN | 204555023 | U | 8/2015 |
| CN | 204555024 | U | 8/2015 |
| CN | 105003965 | A | 10/2015 |
| CN | 204786798 | U | 11/2015 |
| CN | 204853864 | U | 12/2015 |
| CN | 204901976 | U | 12/2015 |
| CN | 204901976 | U * | 12/2015 |
| CN | 205316478 | U | 6/2016 |
| CN | 106152437 | A | 11/2016 |
| CN | 206018823 | U | 3/2017 |
| CN | 106839119 | A | 6/2017 |
| CN | 107401776 | A | 11/2017 |
| CN | 107449038 | A | 12/2017 |
| CN | 207146545 | U | 3/2018 |
| CN | 207334909 | U | 5/2018 |
| EP | 3339755 | A1 | 6/2018 |
| JP | 2004101072 | A | 4/2004 |
| JP | 2004197988 | A | 7/2004 |
| JP | 3748046 | B2 | 2/2006 |
| JP | 2015206495 | A | 11/2015 |
| WO | 2017024637 | A1 | 2/2017 |

OTHER PUBLICATIONS

CN204901976U_Description_202109291251, machine translation of CN204901976U (Year: 2015).*

World Inteli Fctual Property Organization (WIPO) International Search Report for PCT/CN2018/084928 dated Jun. 5, 2018 7 Pages.

The State Intellectual Property Office of PRC (SIPO) The First Office Action For CN Application No. 201710643842.2 dated May 13, 2019 14 Pages (Translation Included ).

The State Intellectual Property Office of PRC (SIPO) The Second Office Action For CN Application No. 201710643842.2 Feb. 3, 2020 7 Pages (Translation Included ).

The State Intellectual Property Office of PRC (SIPO) The First Office Action For CN Application No. 201810393584.1 Dec. 16, 2019 15 Pages (Translation Included ).

The European Patent Office (EPO) Extended Search Report for EP Application No. 18841337.1 Apr. 7, 2020 12 Pages.

The State Intellectual Property Office of PRC (SIPO) The Second Office Action For CN Application No. 201810393584.1 Jul. 15, 2020 13 Pages (Translation Included ).

Japan Patent Office Reasons for Refusal For Japanese Application No. 2019557374 Dec. 1, 2020 10 Pages (including English translation).

The European Patent Office (EPO) Extended Search Report for EP Application No. 18841337.1 Mar. 1, 2022 7 Pages.

* cited by examiner

AIR CONDITIONER INDOOR UNIT

CROSS-REFERENCE TO RELATED APPLICATIONS

This application is a continuation of International Application No. PCT/CN2018/084928, filed Apr. 27, 2018, which claims priority to Chinese Application Nos. 201710643842.2 and 201720948871.5, both filed Jul. 31, 2017, the entire contents of all of which are incorporated herein by reference.

FIELD

The present disclosure relates to a technical field of household appliances, and more particularly to an air conditioner indoor unit.

BACKGROUND

With the improvement of living standard, consumers have attached an increasing importance to user experience of goods. In terms of air conditioner, comfortable experience is required in addition to cooling and heating. The users usually turn on the air conditioner for cooling in hot summer, but it is not comfortable if the cold wind directly blows toward them. Some physically weak people, including elders, pregnant women, and children, are vulnerable to disease related to air conditioning.

SUMMARY

The purpose of the present disclosure is to address at least one of the technical problems existing in the related art. For this purpose, the present disclosure proposes an air conditioner indoor unit, which can realize a windless air effect.

The air conditioner indoor unit based on the present disclosure includes a body provided with an air outlet; an outer air deflector provided at the air outlet, and used to open and close the air outlet; an inner air deflector provided at the air outlet and located inside the outer air deflector, the inner air deflector being formed with a plurality of vent holes penetrating the inner air deflector in a thickness direction, and a total area of the plurality of vent holes being not smaller than 50% of a total area of the inner air deflector.

In the air conditioner indoor unit based on the present disclosure, the plurality of vent holes are provided in the inner air deflector, and the total area of the plurality of vent holes is not smaller than 50% of the total area of the inner air deflector, such that while the airflow passes from the vent holes, not only the air speed and volume can be reduced, but also the indoor cooling and heating efficiency can be ensured.

In some embodiments, the total area of the inner air deflector is not smaller than 45% of a total area of the air outlet.

In some embodiments, a projection area of inner air deflector along the thickness direction of the inner air deflector is not smaller than 70% of a total area of the air outlet.

In some embodiments, the vent hole includes a first hole section and a second hole section successively connected along an air outlet direction, and an outlet size of the first hole section is bigger than an inlet size of the second hole section, so as to form a parting surface.

In some embodiments, the first hole section gradually tapers along the air outlet direction, while the second hole section gradually expands along the air outlet direction.

In some embodiments, the parting surface is a plane.

In some embodiments, an inlet area of the vent hole is not bigger than an outlet area of the vent hole.

In some embodiments, a distance between a parting surface and an outlet end of the vent hole is not bigger than a half of a total length of the vent hole.

In some embodiments, diameter of at least a part of the plurality of vent holes are increased or decreased sequentially or keep unchanged from top to bottom.

In some embodiments, at least a part of the plurality of vent holes are arranged sequentially along a preset straight line or curve.

In some embodiments, the diameter of the vent hole ranges from 2 mm to 4 mm.

In some embodiments, when the inner air deflector is perpendicular to the air outlet direction, an included angle between a center line of the vent hole and the horizontal plane ranges from −10° to 10°.

In some embodiments, the inner air deflector is rotatable between a windless mode and an open mode. In the open mode, the inner air deflector extends into the air outlet and is arranged along the air outlet direction. In the windless mode, the inner air deflector is flush with an outer contour of the body.

In some embodiments, the inner air deflector is made of at least one material selected from common ABS, modified ABS, PC, and modified PC.

In some embodiments, the vent hole has a circular, oval, triangular or polygonal cross section.

Additional aspects and advantages of embodiments of present disclosure will be given in part in the following descriptions, become apparent in part from the following descriptions, or be learned from the practice of the embodiments of the present disclosure.

Figure 1:
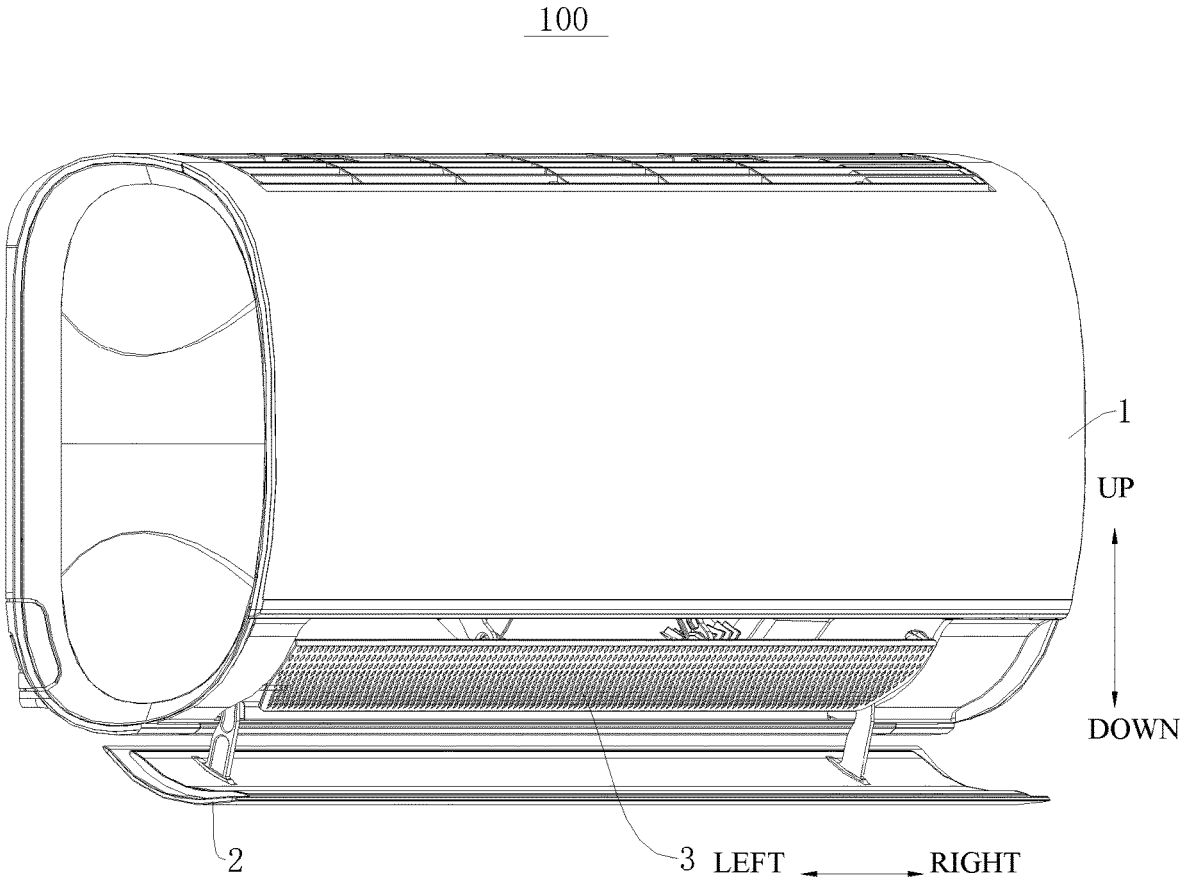
FIG. 1 is a schematic view of the air conditioner indoor unit based on embodiments of the present disclosure, where the outer air deflector opens the air outlet and the inner air deflector is in the windless mode.

REFERENCE NUMERALS air conditioner indoor unit 100,
body 1, air outlet 11,
outer air deflector 2,
inner air deflector 3, vent hole 31, first hole section 311, second hole section 312, parting surface 313.

DETAILED DESCRIPTION

The embodiments of the present disclosure are described in detail below, and examples of the embodiments are shown in the attached drawings, throughout which the identical or similar labels are used to denote the identical or similar elements or elements having identical or similar functions. The embodiments described below by reference to the attached drawings are illustrative and are used only to interpret the present disclosure but should not be construed as restrictions on the present disclosure.

The indoor unit 100 based on the embodiment of the present disclosure is described below with reference to FIGS. 1-14. The indoor unit 100 and outdoor unit are assembled into an air conditioner, to adjust the ambient indoor temperature. The air conditioner can be wall-mounted split air conditioner, cooling air conditioner, and cooling and heating air conditioner. The present disclosure uses cooling and heating air conditioner as an example. The indoor unit 100 offers three air supply modes: windless mode, cooling mode, and heating mode.

Figure 2:
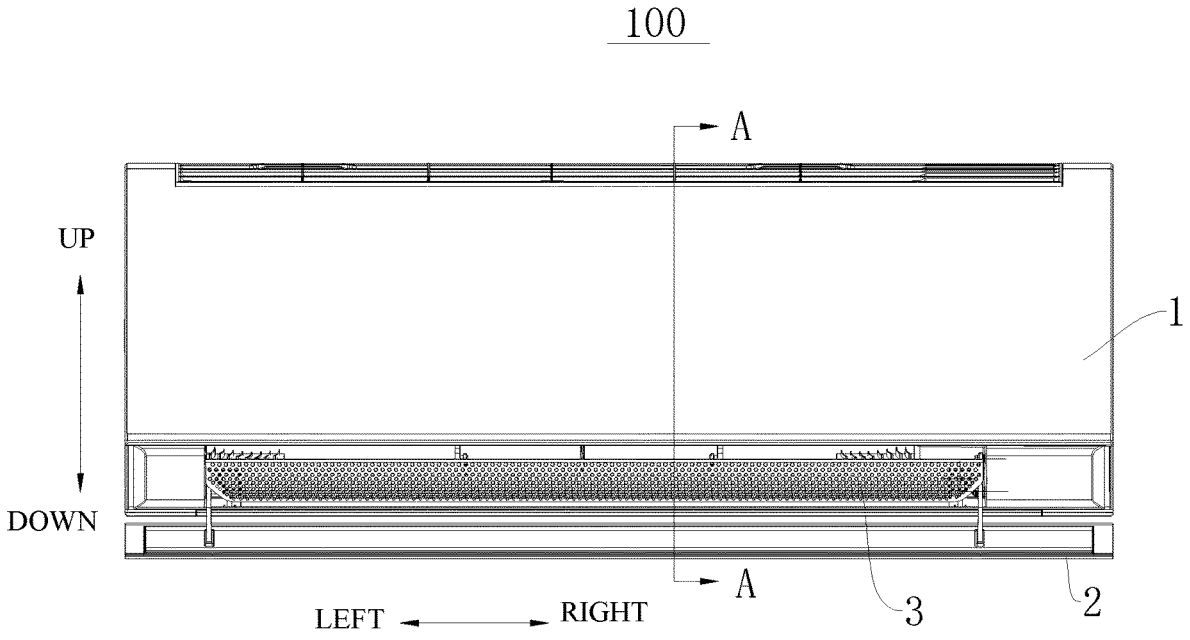
FIG. 2 is another schematic view of the air conditioner indoor unit in FIG. 1 from another angle.
Figure 3:
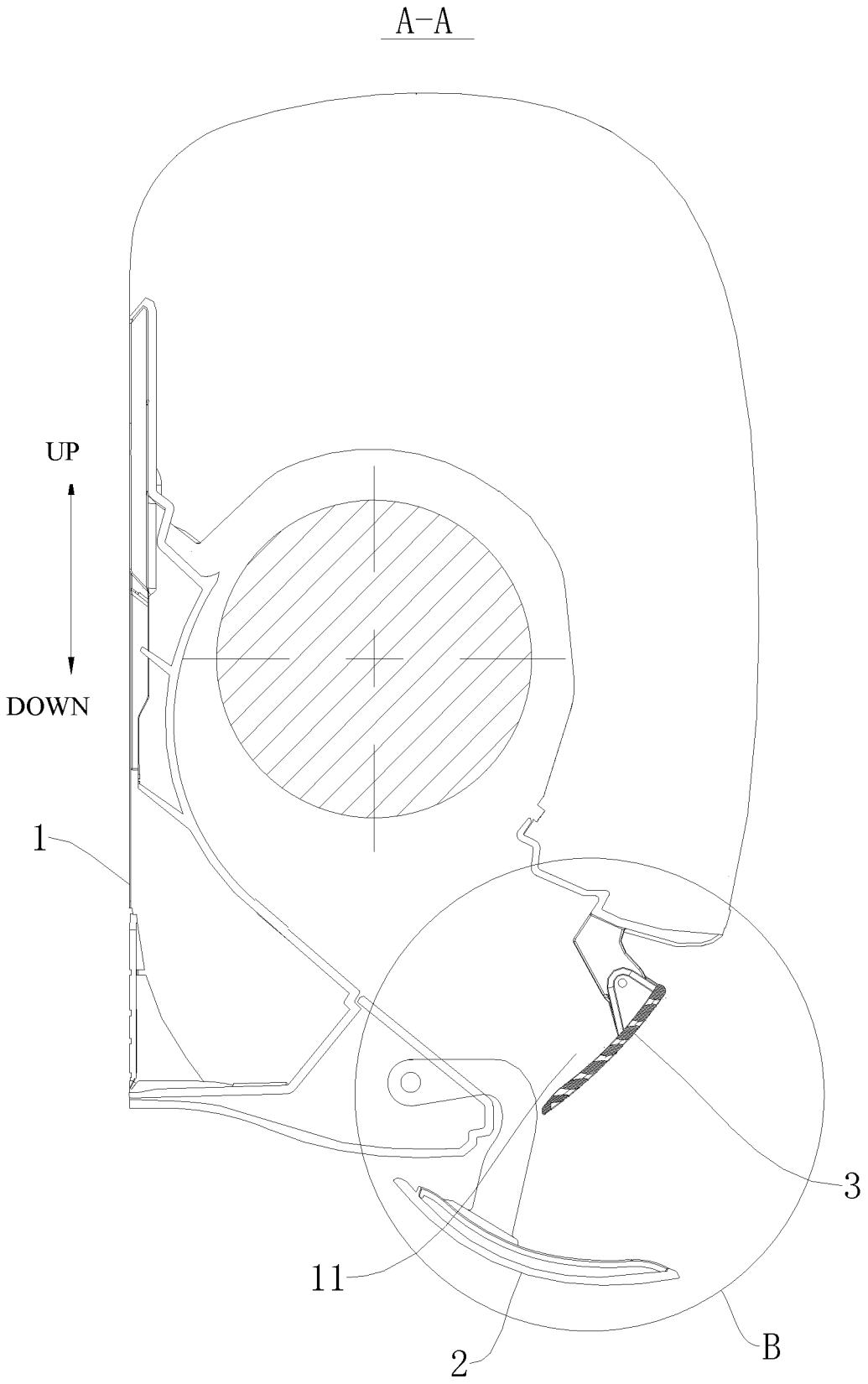
FIG. 3 is a cross-sectional view along A-A line.

As shown in FIGS. 1-3, the indoor unit 100 based on the embodiment of the present disclosure comprises body 1, outer air deflector 2, and inner air deflector 3. All components of the indoor unit 100 can be housed in the body 1. The body 1 can support and protect internal parts, and serve as the decoration.

The body 1 comprises chassis, face frame and panel. The face frame is located on the chassis, and the front of the face frame is open. The panel is located in front of the face frame, and the lower end of the panel forms the air outlet 11 with the face frame. Specifically, the face frame can be arranged on the chassis in a rotatable or detachable manner, and the panel can be arranged on the face frame in a rotatable or detachable manner. It is understandable that outlet face frame, used for ventilation, is located in the body 1, and the indoor unit 100 also comprises heat exchanger, fan, and electric control box.

Specifically, the air outlet 11 is mounted on the body 1; the outer air deflector 2 is located at the air outlet 11, and used to open and close the air outlet 11; for instance, the outer air deflector 2 can be pivotally connected to the edge of the air outlet 11, and the air outlet 11 can be opened and closed by rotating the outer air deflector 2. When the outer air deflector 2 opens the air outlet 11, the interior of indoor unit 100 is connected to the indoor space, the air can flow toward the indoor space through the air outlet 11, and the outer air deflector 2 can direct the air outlet direction; when the outer air deflector 2 closes the air outlet 11, the outer air deflector 2 is flush with the contour of the body 1 to close the air outlet 11, and the interior of indoor unit 100 is not connected to the indoor space.

In some embodiments, the outer air deflector 2 can rotate around its axis to achieve airflow swing during the operation of the indoor unit 100.

The inner air deflector 3 is located at the air outlet 11 and at an inner side of the outer air deflector 2. In some embodiments, the inner air deflector 3 can be arranged rotatably at the air outlet 11, and when the inner air deflector 3 rotates to a certain angle, the inner air deflector 3 can direct the airflow to adjust the air outlet angle. In some embodiments, the inner air deflector 3 can rotate around its axis to achieve airflow swing during the operation of the indoor unit 100.

Further, the inner air deflector 3 is formed with a plurality of vent holes 31 penetrating the inner air deflector in a thickness direction of the inner air deflector 3. Optionally, the cross section of the vent hole 31 is a circle, oval, triangle, or polygon.

Figure 11:
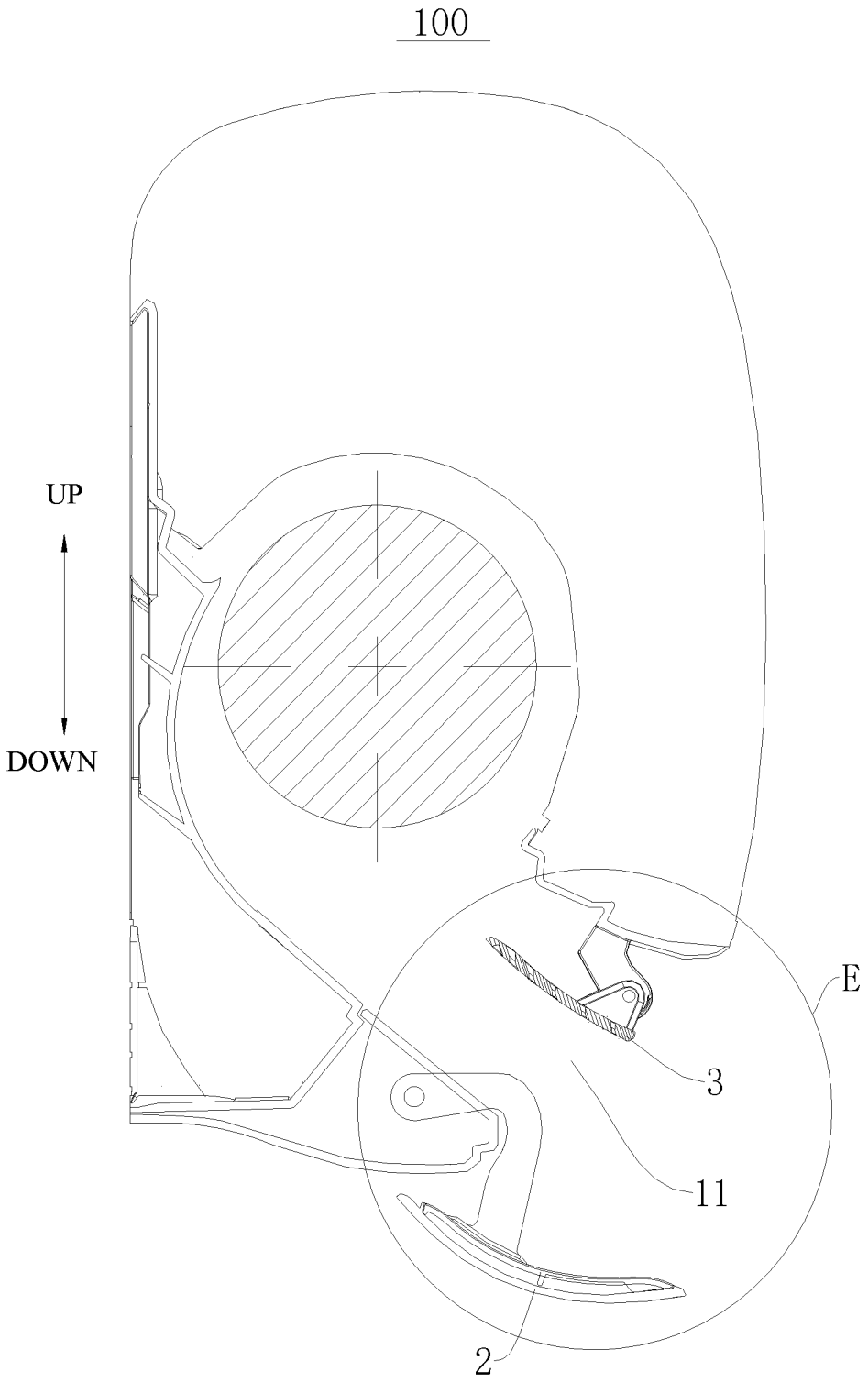
FIG. 11 is a cross-sectional view of the air conditioner indoor unit in FIG. 10.
Figure 12:
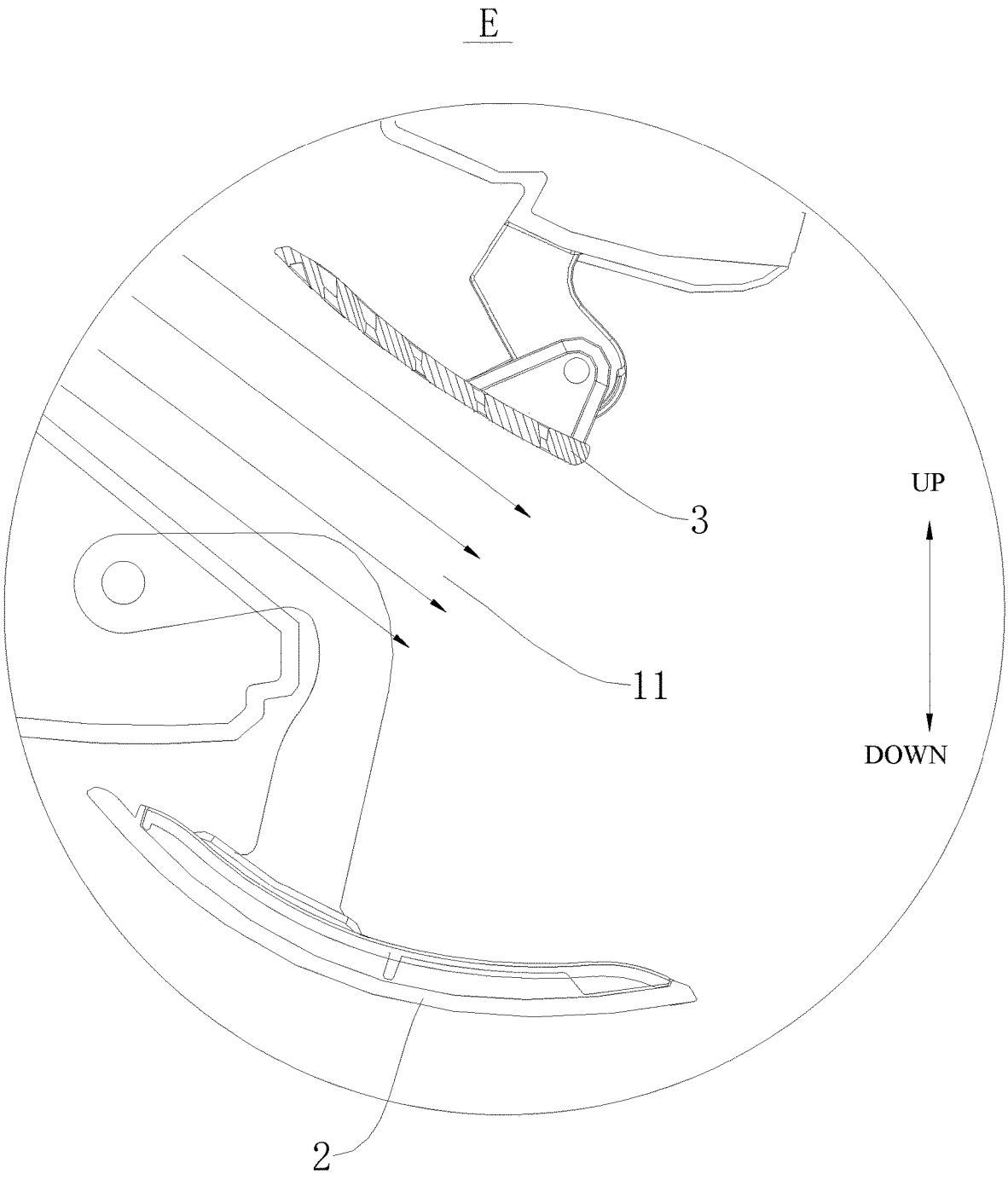
FIG. 12 is an enlarged view of Part E in FIG. 11.

In some embodiments, the inner air deflector 3 can rotate between windless mode (the state of the inner air deflector in FIG. 4) and open mode (the state of the inner air deflector 3 in FIG. 11). As shown in FIG. 11, when the inner air deflector 3 is open, the inner air deflector 3 extends into the air outlet 11 and is arranged along the air outlet direction (the inner air deflector 3 is roughly parallel to the air outlet direction). In windless mode, the inner air deflector is flush with the contour of the body. If the outer air deflector 2 is rotated to open the air outlet 11, the air can directly flow out through the air outlet 11, and the indoor unit 100 is in wind mode, i.e., directly blowing cold or hot wind, to adjust the indoor temperature. In this case, the outer air deflector 2 and the inner air deflector 3 can direct airflow to improve the cooling or heating effect.

Figure 4:
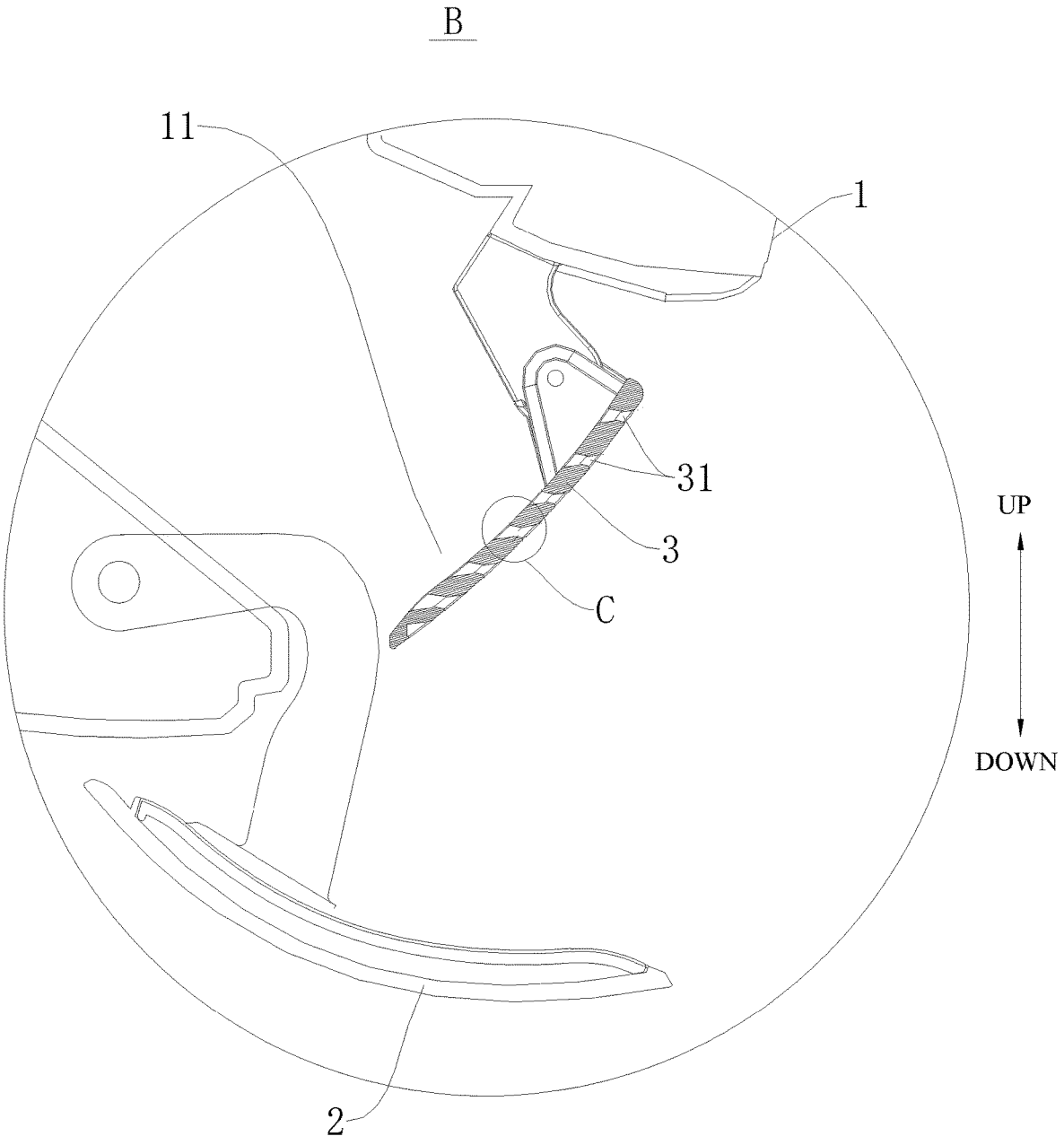
FIG. 4 is an enlarged view of Part B in FIG. 3.
Figure 6:
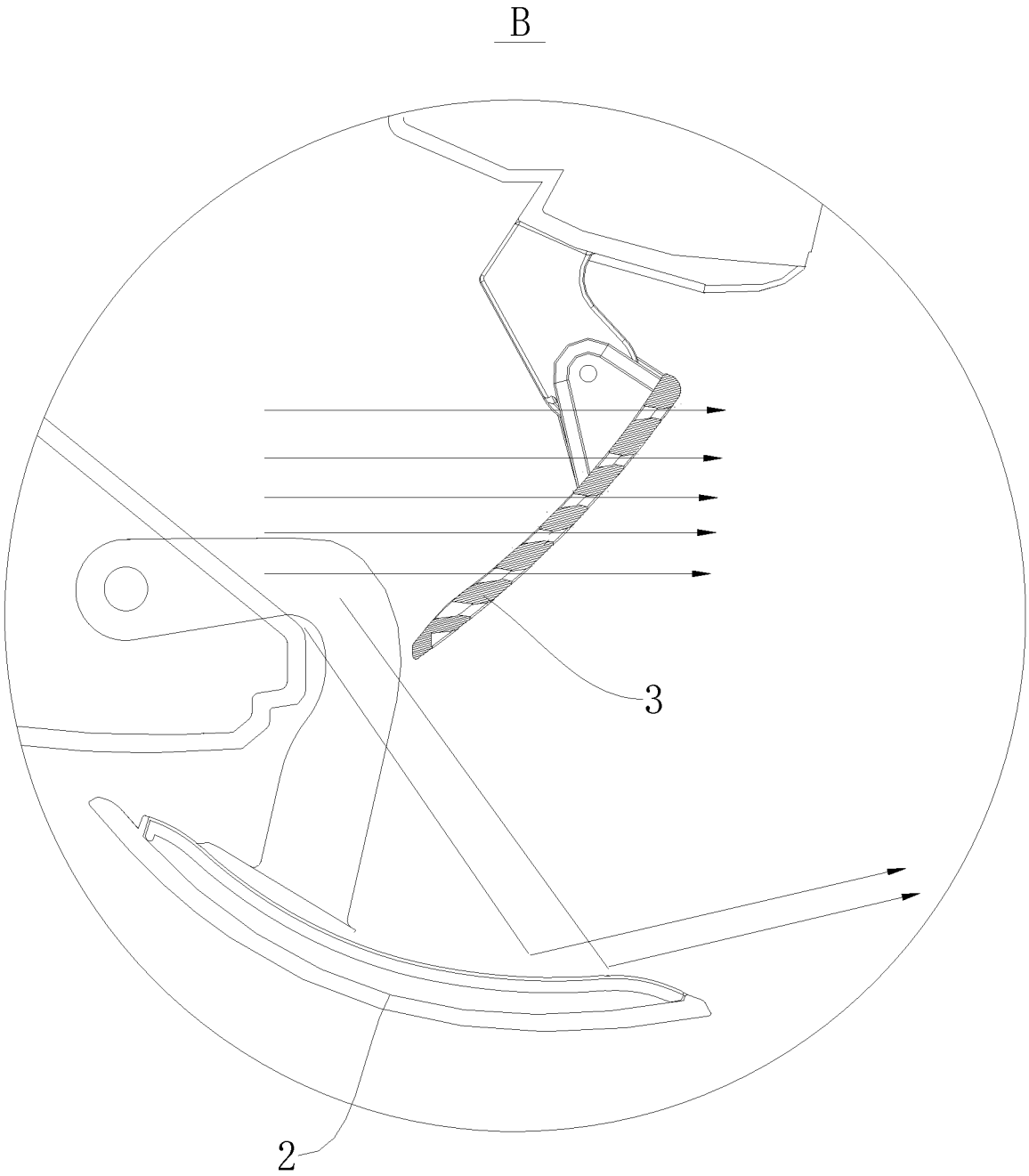
FIG. 6 is an enlarged view of Part B in FIG. 3, and the arrows indicate the air outlet direction.
Figure 7:
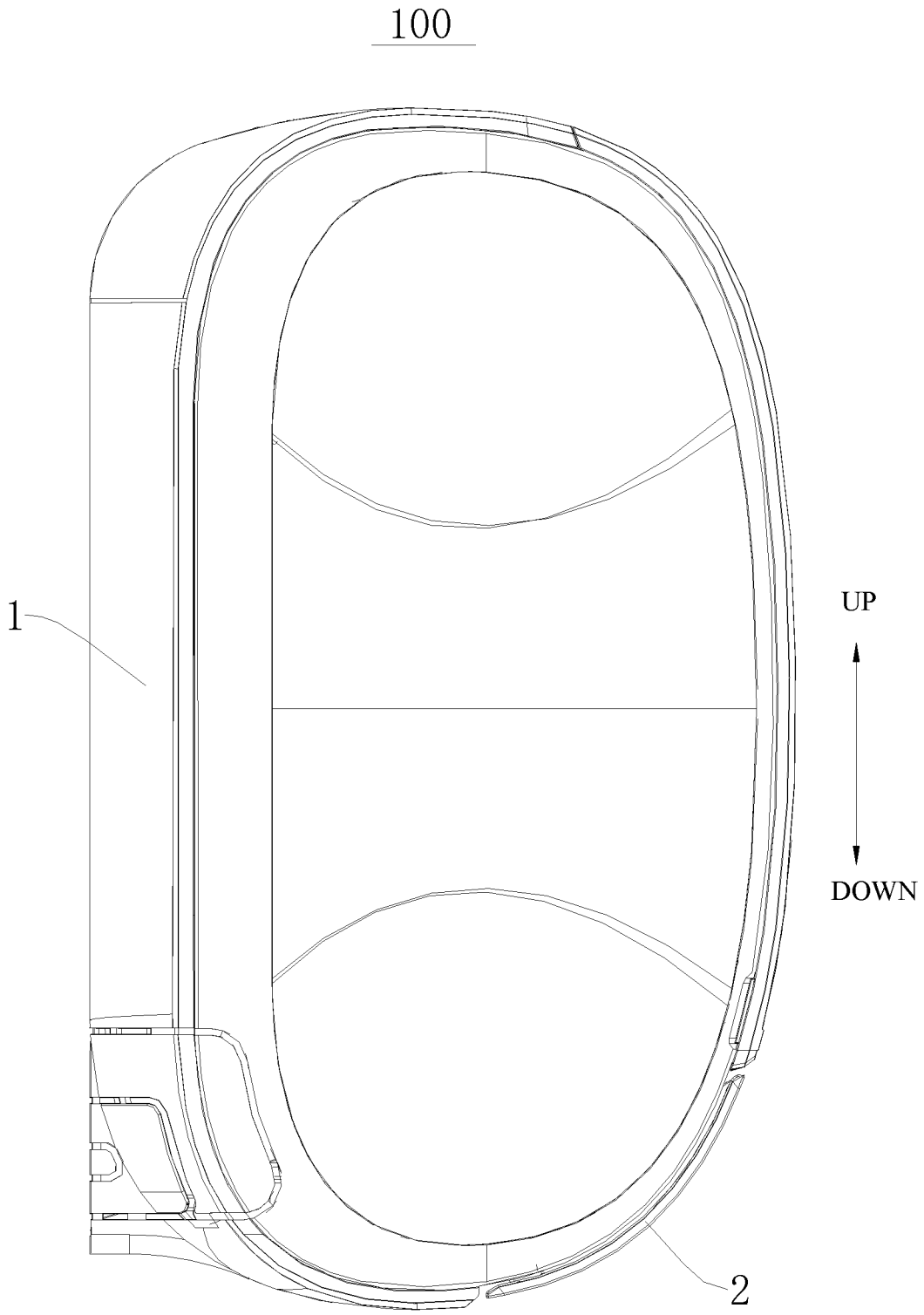
FIG. 7 is a schematic view of the air conditioner indoor unit based on embodiments of the present disclosure, where the outer air deflector closes the air outlet.
Figure 8:
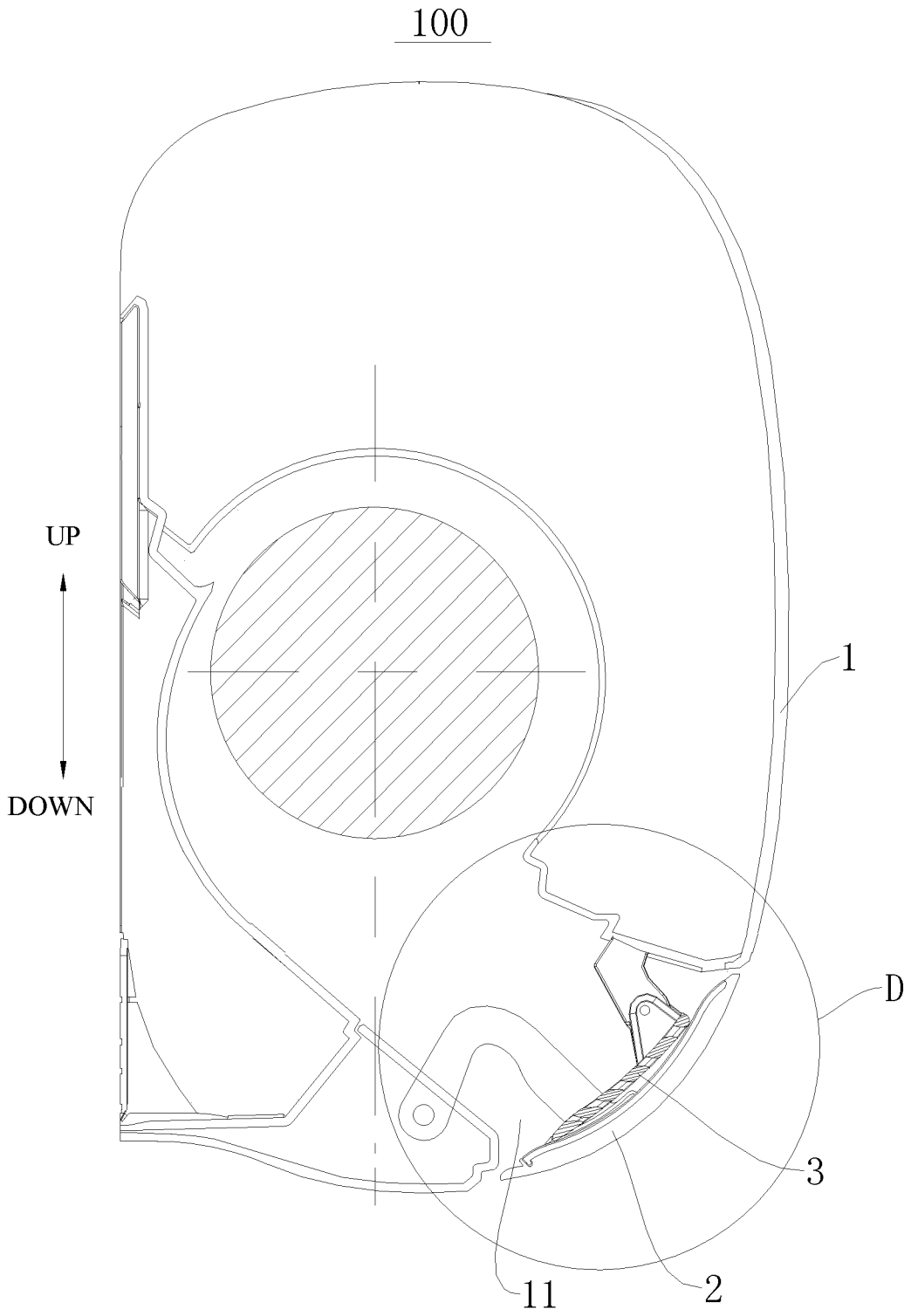
FIG. 8 is a cross-sectional view of the air conditioner indoor unit in FIG. 7.
Figure 9:
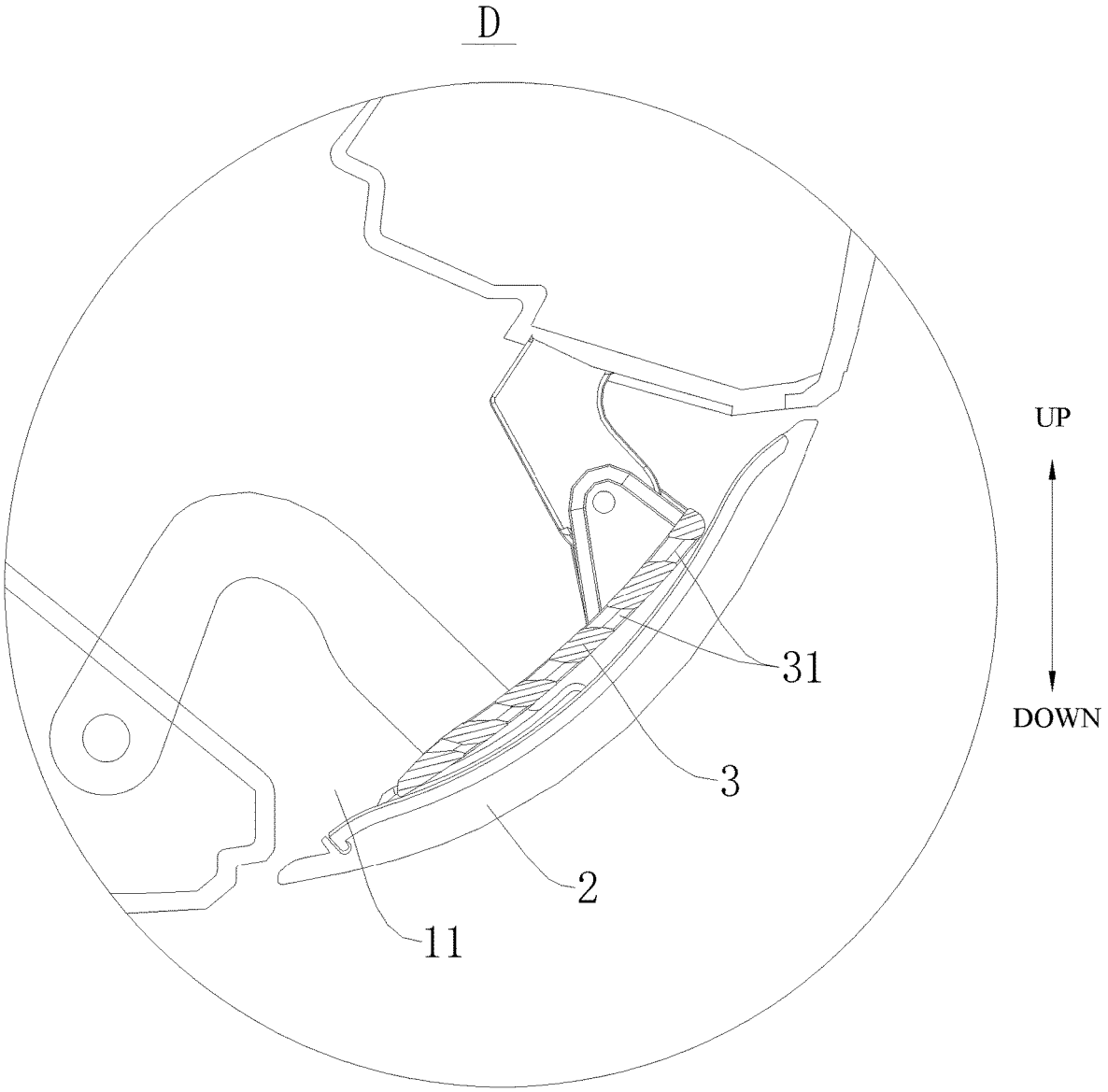
FIG. 9 is an enlarged view of Part D in FIG. 8.
Figure 10:
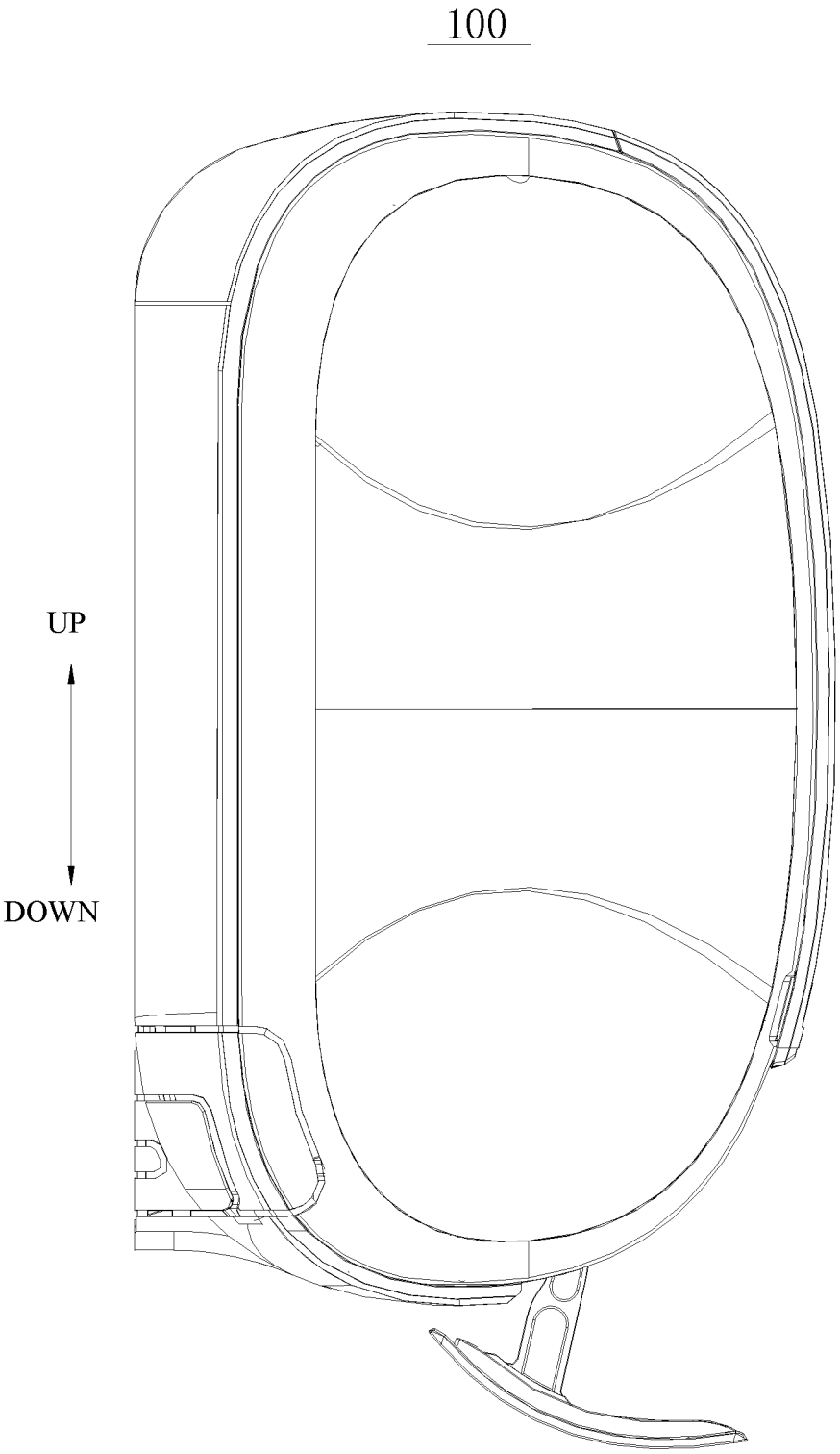
FIG. 10 is a schematic view of the air conditioner indoor unit based on embodiments of the present disclosure, where the outer air deflector opens the air outlet and the inner air deflector is in the open state.

As shown in FIG. 4 and FIG. 6, the inner air deflector 3 in windless mode is flush with the contour of the body 1 (the inner air deflector 3 is roughly perpendicular to the air outlet direction). If the outer air deflector 2 is rotated to open the air outlet 11, the air can flow out through the vent holes 31 on the inner air deflector 3, and the indoor unit 100 is in wind mode. During the process, the inner air deflector 3 can prevent the airflow, only allowing the air to flow out through the vent holes 31. It can decrease the speed and volume of wind to almost windless air supply. Therefore it can avoid the cold wind directly blowing toward people, which may cause related disease, and offer users better experience.

Further, the total area of vent holes 31 on the inner air deflector 3 is not smaller than 50% of the area of the inner air deflector 3. Therefore it can assure the indoor cooling and heating efficiency while decreasing the speed and volume of wind.

For the indoor unit 100 based on the present disclosure, there are the plurality of vent holes 31 on the inner air deflector 3, and the total area of the vent holes 31 is not smaller than 50% of that of the inner air deflector 3. In this case, while the airflow passes through the vent holes 31, it not only can decrease the speed and volume of wind, but also can assure the indoor cooling and heating efficiency.

If the total area of the inner air deflector is too small, it cannot decrease the speed and volume of wind of the air outlet 11 effectively. In some embodiments, the total area of the inner air deflector 3 is not smaller than 45% of the area of the air outlet 11. In this case, it can assure that the speed and volume of wind can be decreased to almost windless air supply when the inner air deflector is perpendicular to the air outlet direction. For instance, the total area of the inner air deflector 3 can be larger than 55%, 65%, or 75% of that of the air outlet 11.

It should be noted that the total area of the inner air deflector 3 includes the areas of vent holes 31 on the inner air deflector 3.

In some embodiments of the present disclosure, the projected area of inner air deflector 3 along its thickness direction is not smaller than 70% of the total area of the air outlet 11. Therefore the inner air deflector 3 can effectively decrease the speed and volume of wind of the air outlet 11 to achieve windless effect and offer better user experience. For instance, the projected area of inner air deflector 3 along its thickness direction can be 80%, 85%, or 90% of the total area of the air outlet 11.

Figure 5:
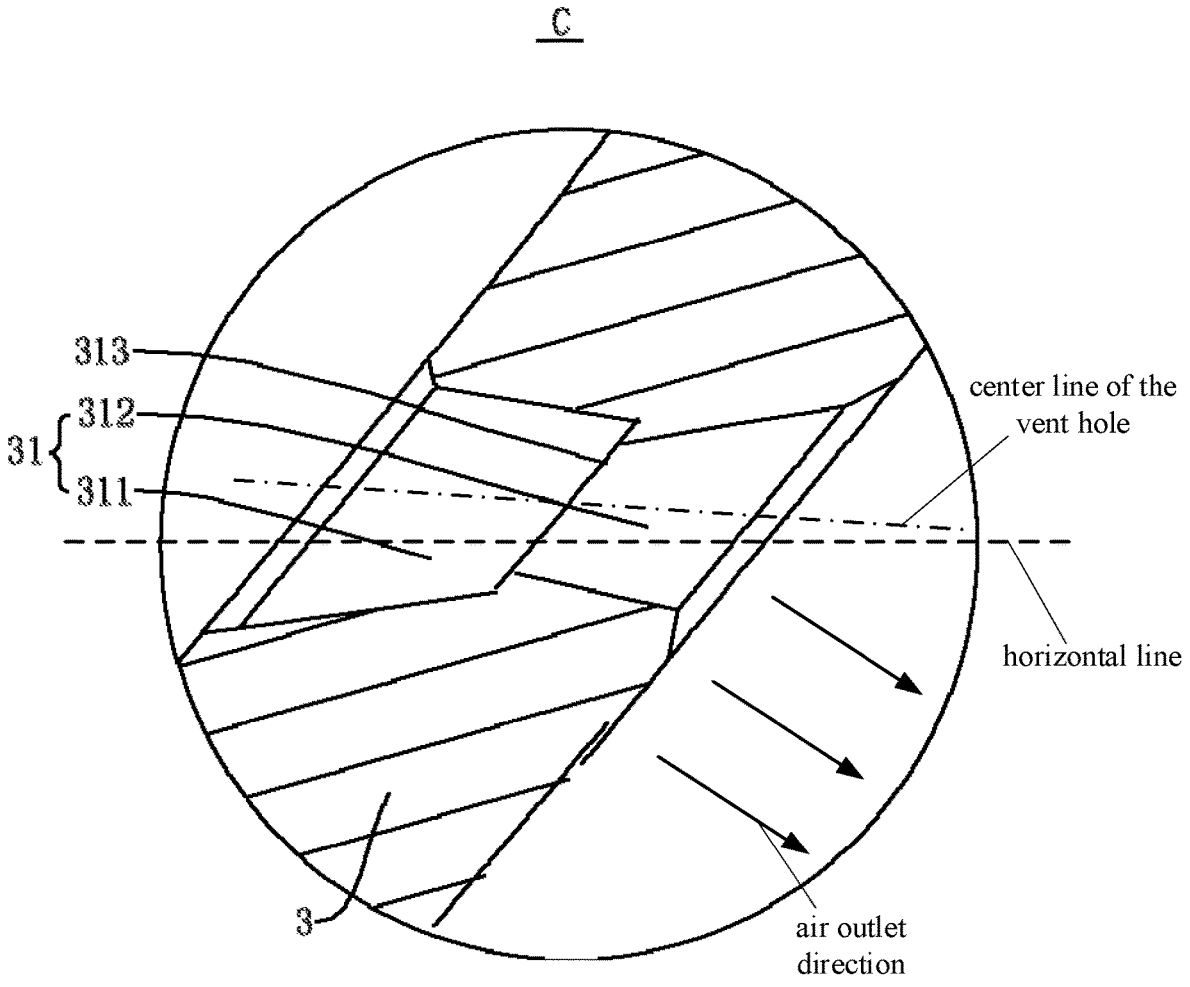
FIG. 5 is an enlarged view of Part C in FIG. 4.

In some embodiments of the present disclosure, as shown in FIGS. 4-6, the vent hole 31 can comprise the first hole section 311 and the second hole section 312 which are successively connected along the air outlet direction (indicated by the arrows in FIG. 6). The outlet size of the first hole section 311 is bigger than the inlet size of the second hole section 312, so as to form the parting surface 313 at the connection of the first hole section 311 and the second hole section 312. The parting surface 313 can further decrease the speed and volume of wind in the vent hole 31, and achieve windless effect. In addition, the parting surface 313 facilitates the formation of the vent hole 31, and simplifies the structure.

Further, as shown in FIG. 5, the first hole section 311 gradually tapers along the air outlet direction, while the second hole section 312 gradually expands along the air outlet direction. In other words, the hole diameter of the first hole section 311 gradually decreases, while the hole diameter of the second hole section 312 gradually increases along the air outlet direction. Therefore the volume and speed of wind can be gradually reduced in the first hole section 311 and the second hole section 312, respectively. It helps to achieve the windless effect.

Optionally, as shown in FIG. 5, parting surface 313 can be a plane. It can simplify the structure, facilitate processing, and decrease the speed and volume of wind.

In some embodiments, the inlet area is not bigger than the outlet area of the vent hole 31. In other words, the inlet area can be equal to or smaller than the outlet area of the vent hole 31. Therefore the air outlet speed can be smaller than the air inlet speed. It can decrease the volume and speed of wind and achieve the windless effect.

The present disclosure is not limited thereto, and the inlet area can be bigger than the outlet area of the vent hole 31, to decrease the volume of wind of the outlet.

In some embodiments, the distance between parting surface 313 and outlet of the vent hole 31 is not larger than a half of the total length of the vent hole 31. It can further help to achieve windless effect.

Figure 13:
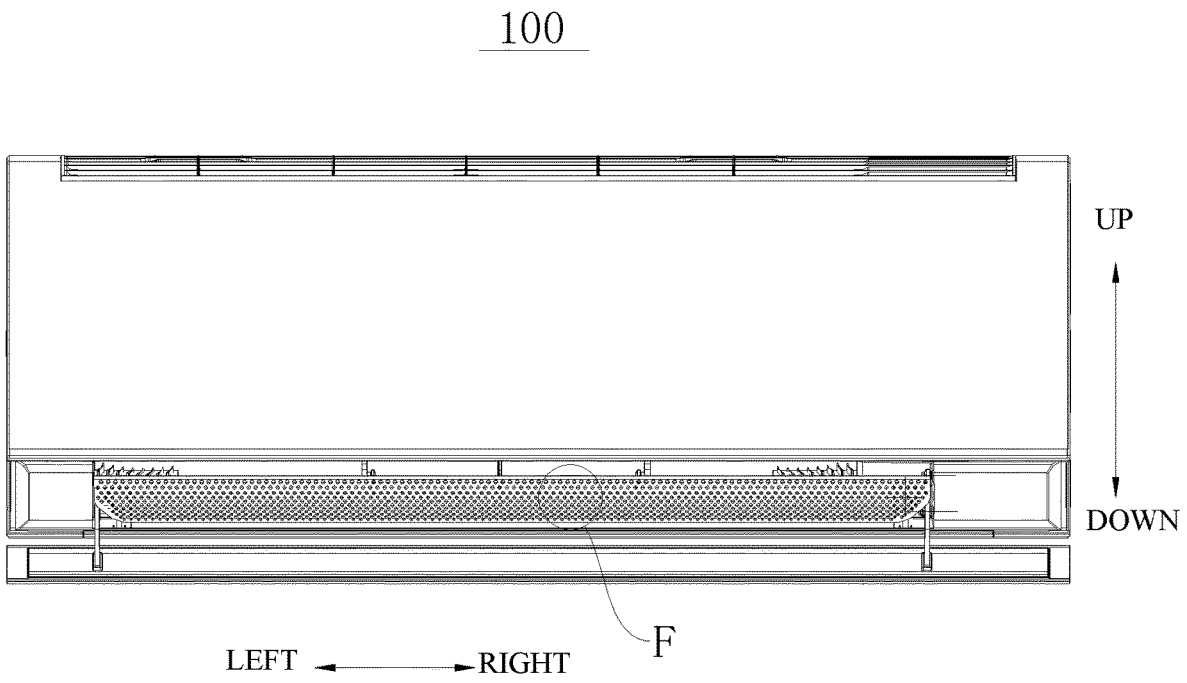
FIG. 13 is a schematic view of the air conditioner indoor unit in FIG. 2.
Figure 14:
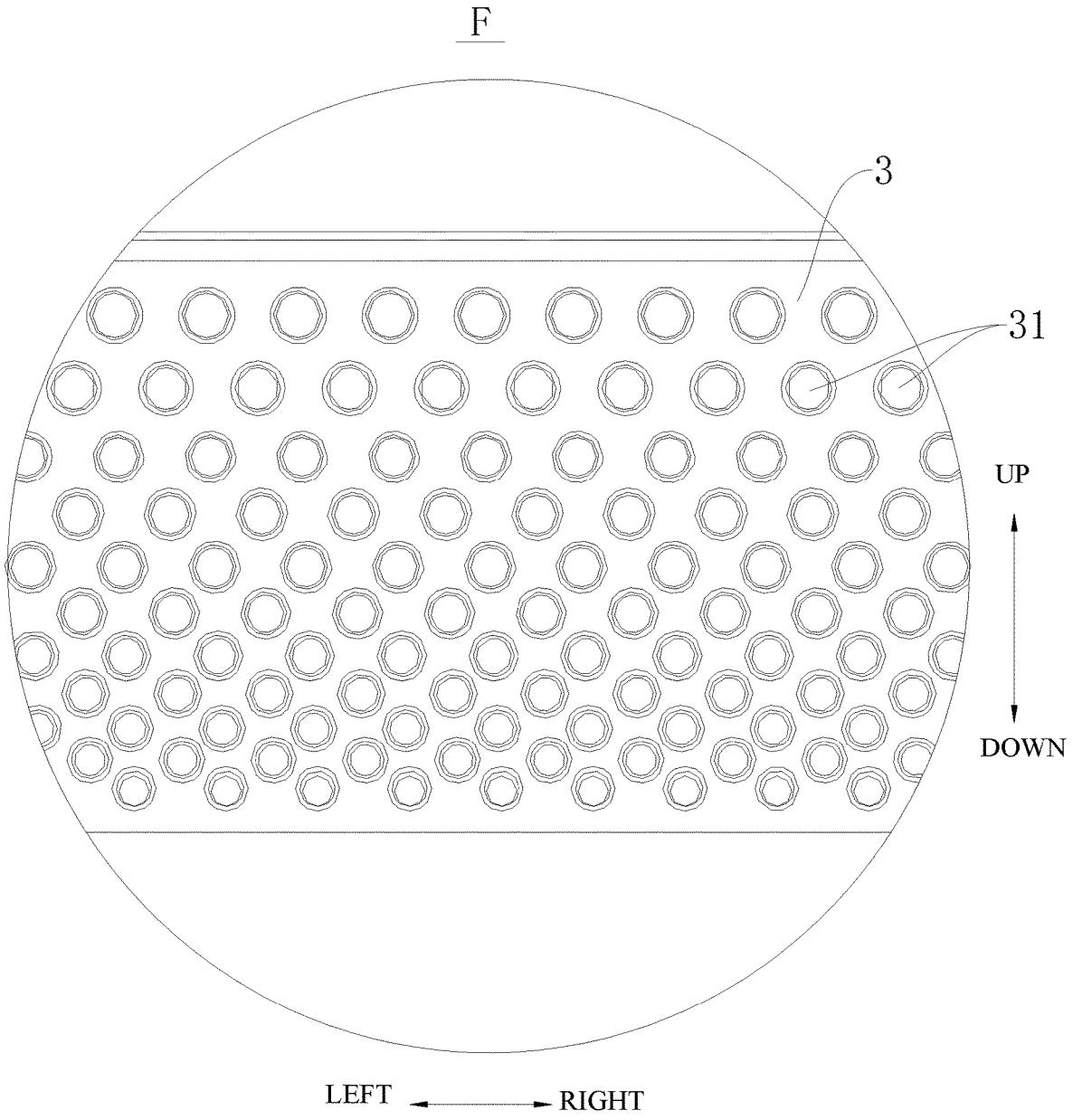
FIG. 14 is an enlarged view of Part F in FIG. 13.

In some embodiments, as shown in FIG. 13 and FIG. 14, the diameters of at least some vent holes 31 increase, decrease, or keep unchanged from top of the inner air deflector 3 to bottom of the inner air deflector 3. In other words, the diameters of at least some vent holes 31 on the inner air deflector 3 decrease from top to bottom; the diameters of at least some vent holes 31 on the inner air deflector 3 increase from top to bottom; or the diameters of at least some vent holes 31 on the inner air deflector 3 are uniform, i.e., remain unchanged, from top to bottom. Therefore the diameters of the vent holes 31 at different positions of the inner air deflector 3 can vary according to specific outlet requirement, which enhances adaptability.

In some embodiments, at least some vent holes 31 are arranged along the designated straight line, while at least some vent holes 31 are arranged along the designated curve. Therefore the positions of the vent holes 31 can be arranged to meet different needs and offer better appearance.

For instance, multiple columns of vent holes are spaced along the length (left and right direction indicated in FIG. 13) on the inner air deflector 3, each column of vent holes comprise a plurality of vent holes 31 spaced along the up and down direction, and the plurality of vent holes 31 of neighboring two columns of vent holes are staggered along the up and down direction. In some embodiments, the plurality of vent holes 31 of neighboring two columns of vent holes can be left and right aligned.

Change in diameter of the vent hole 31 can change the speed and volume of wind, which helps to achieve the windless effect. Therefore, in some embodiments, the diameter of the vent hole 31 is between 2 mm and 4 mm. In this case, it not only can decrease the speed and volume of wind, but also can assure the indoor cooling and heating efficiency.

In some embodiments, as shown in FIG. 6, the included angle between the center line of the vent hole 31 and horizontal plane is between −10 degrees and 10 degrees when the inner air deflector 3 is perpendicular to the air outlet direction. In some embodiments, the included angle between the center line of the vent hole 31 and horizontal plane is between −5 degrees and 5 degrees when the inner air deflector 3 is perpendicular to the air outlet direction. In some embodiments, center line of the vent hole 31 is roughly parallel to the horizontal plane when the inner air deflector 3 is perpendicular to the air outlet direction. Therefore it allows the air to flow out along roughly horizontal direction, which can prevent the wind from directly blowing toward people, and offer users better experience.

In some embodiments, the inner air deflector 3 is made of at least one of common ABS (acrylonitrile-butadiene-styrene), modified ABS, PC (polycarbonate), or modified PC.

The working process of the indoor unit 100 in the embodiments of the present disclosure is as below.

The indoor unit 100 in the embodiments of the present disclosure offers three air supply modes: windless mode, cooling mode, and heating mode. During the operation of the indoor unit 100, the indoor unit 100 is turned on, and a selection of the air supply mode is received.

If windless mode is selected, the outer air deflector 2 opens the air outlet 11, and the inner air deflector 3 rotates to a state in which the inner air deflector 3 is roughly perpendicular to the air outlet direction. The wind in the body 1 flows out form the plurality of vent holes 31, which reduces the speed of wind and achieves the windless effect. Moreover, the outer air deflector 2 can rotate to be within the airflow range of the air outlet 11 to change the direction of wind.

If cooling mode or heating mode is selected, the outer air deflector 2 opens the air outlet 11, and inner air deflector 3 rotates to a state in which the inner air deflector 3 is roughly parallel to the air outlet direction.

In the description of the present disclosure, it should be understood that the orientation or position relations indicated with the terms "center," "length," "width," "thickness," "up," "down," "front," "rear," "left," "right," "vertical," "horizontal," "top," "bottom" "inner" and "outer," "axial," "radial" or "circumferential" are based on the orientation or position relationship shown in the attached drawings, are used only for the convenience of describing the present disclosure and simplifying the description, rather than indicating or implying that the device or element referred to must have a particular orientation, be constructed and operated in a particular orientation, so they shall not be construed as a restriction on the present disclosure.

In addition, terms "first" and "second," are used only for the description, rather than indicating or implying relative importance or stating implicitly the quantity of the indicated technological features. Therefore a feature associated with "first" and "second" may, explicitly or implicitly, comprise one or more such features. Unless otherwise stated, the term "a plurality of" means two or more in the description of the present disclosure.

In the description of the present disclosure, unless otherwise expressly specified and defined, the terms "installation," "linking" and "connection" shall be understood generally, for example, it may be fixed connection, detachable connection, or integral connection; or mechanical or electrical connections; or direct linking, indirect linking through an intermediate medium, or internal connection or interaction of two components. The specific meaning of the above terms in the present disclosure may be understood on a case by case basis by common technicians in the field.

In the description of the present disclosure, the terms "an embodiment," "some embodiments," "example," "specific example," or "some examples" etc. mean that the specific feature, structure, material or characteristic of that embodiment or example described are included in at least one embodiment or example of the present disclosure. In this description, the schematic presentation of such terms may not refer to the same embodiment or example. Moreover, the specific features, structure, material or characteristics described may be combined in an appropriate manner in any one or multiple embodiments or examples. In addition, common technicians can combine and integrate the features in any one or multiple embodiment or examples, if no contradiction exists.

Although the embodiments of the present disclosure have been presented and described, the common technicians in the field can understand that various changes, modifications, substitutions and variations of such embodiments can be made without deviating from the principles and purposes of the present disclosure, and that the scope of the present invention is defined by the claims and their equivalents.

What is claimed is:

1. An air conditioner indoor unit comprising:

a body including an air outlet;

an outer air deflector rotatably mounted at a first side of the air outlet, and configured to open and close the air outlet; and an inner air deflector located at an inner side of the outer air deflector and rotatably mounted at a second side of the air outlet that is opposite to the first side, the inner air deflector including a plurality of vent holes penetrating the inner air deflector in a thickness direction of the inner air deflector, a total area of the plurality of vent holes being not smaller than 50% of a total area of the inner air deflector, and the total area of the inner air deflector being larger than 75% of a total area of the air outlet;

wherein:

the inner air deflector is rotatable between:

an open state in which the inner air deflector extends into the air outlet and is arranged along an air outlet direction; and a windless mode in which the inner air deflector is flush with an outer contour of the body and allows air flow out through the plurality of vent holes;

at least one of the plurality of vent holes includes a first hole section and a second hole section successively connected along the air outlet direction; and an outlet size of the first hole section is larger than an inlet size of the second hole section, a parting surface being formed between the first hole section and the second hole section.

2. The indoor unit according to claim 1, wherein the parting surface is a plane.

3. The indoor unit according to claim 1, wherein a distance between the parting surface and an outlet end of the at least one of the plurality of vent holes is not larger than a half of a total length of the least one of the plurality of vent holes.

4. The indoor unit according to claim 1, wherein the first hole section tapers gradually along the air outlet direction, and the second hole section expands gradually along the air outlet direction.

5. The indoor unit according to claim 1, wherein an inlet area of the at least one of the plurality of vent holes is not larger than an outlet area of the at least one of the plurality of vent holes.

6. The indoor unit according to claim 1, wherein diameters of a part of the plurality of vent holes increase or decrease gradually, or remain unchanged from a top of the inner air deflector to a bottom of the inner air deflector.

7. The indoor unit according to claim 1, wherein a part of the plurality of vent holes are arranged along a straight line or a curve.

8. The indoor unit according to claim 1, wherein a diameter of the at least one of the plurality of vent holes is in a range of 2 mm to 4 mm.

9. The indoor unit according to claim 1, wherein an angle between a center line of the at least one of the plurality of vent holes and a horizontal plane ranges from −10° to 10° when the inner air deflector is perpendicular to the air outlet direction.

10. The indoor unit according to claim 1, wherein the inner air deflector is made of at least one of ordinary acrylonitrile-styrene-butadiene copolymer (ABS), modified ABS, polycarbonate (PC), or modified PC.

11. The indoor unit according to claim 1, wherein each of the plurality of vent holes has a circular, oval, triangular or polygonal cross section.

12. An air conditioner indoor unit comprising:

a body including an air outlet;

an outer air deflector provided at the air outlet, and configured to open and close the air outlet; and an inner air deflector located at an inner side of the outer air deflector, the inner air deflector including a plurality of vent holes penetrating the inner air deflector in a thickness direction of the inner air deflector, and a total area of the plurality of vent holes being not smaller than 50% of a total area of the inner air deflector;

wherein:

one of the plurality of vent holes includes a first hole section and a second hole section successively connected along an air outlet direction; and an outlet size of the first hole section is larger than an inlet size of the second hole section, a parting surface being formed between the first hole section and the second hole section.

* * * * *